US009387350B2

(12) United States Patent
Gopfert et al.

(10) Patent No.: US 9,387,350 B2
(45) Date of Patent: Jul. 12, 2016

(54) SAFETY HARNESS

(75) Inventors: Heinrich Gopfert, Papenburg (DE); Mike Gimmerthal, Aurich (DE)

(73) Assignee: WOBBEN PROPERTIES GMBH, Aurich (DE)

( * ) Notice: Subject to any disclaimer, the term of this patent is extended or adjusted under 35 U.S.C. 154(b) by 0 days.

(21) Appl. No.: 13/983,015

(22) PCT Filed: Feb. 2, 2012

(86) PCT No.: PCT/EP2012/051740

§ 371 (c)(1), (2), (4) Date: Oct. 25, 2013

(87) PCT Pub. No.: WO2012/104368

PCT Pub. Date: Aug. 9, 2012

(65) Prior Publication Data

US 2014/0034419 A1 Feb. 6, 2014

(30) Foreign Application Priority Data

Feb. 3, 2011 (DE) ..... 10 2011 003 579

(51) Int. Cl.
*A62B 35/04* (2006.01)
*A62B 35/00* (2006.01)

(52) U.S. Cl.
CPC ..... *A62B 35/0018* (2013.01); *A62B 35/0037* (2013.01); *A62B 35/04* (2013.01)

(58) Field of Classification Search
CPC ..... A62B 35/005; A62B 35/0062; A62B 35/0081; A62B 1/02; A62B 1/06; A62B 1/14; A62B 1/16; A62B 35/00; A62B 35/04
USPC ..... 182/3, 5–8
See application file for complete search history.

(56) References Cited

U.S. PATENT DOCUMENTS

| | | | | | |
|---|---|---|---|---|---|
| 1,955,473 | A | * | 4/1934 | Raymer | 182/9 |
| 3,444,957 | A | * | 5/1969 | Gilpin, Jr. | 182/3 |
| 3,769,938 | A | * | 11/1973 | Hudziak et al. | 128/874 |
| 4,076,101 | A | * | 2/1978 | Himmelrich | 182/3 |
| 4,100,996 | A | * | 7/1978 | Sharp | 182/3 |
| 4,121,688 | A | * | 10/1978 | Lirakis | 182/3 |
| RE30,072 | E | * | 8/1979 | Kleine et al. | 182/8 |
| 4,253,544 | A | * | 3/1981 | Dalmaso | 182/3 |
| 4,446,944 | A | * | 5/1984 | Forrest et al. | 182/3 |
| 4,618,026 | A | * | 10/1986 | Olson | 182/4 |
| 4,632,217 | A | * | 12/1986 | Markwell et al. | 182/3 |
| 5,080,191 | A | * | 1/1992 | Sanchez | 182/3 |
| 5,090,503 | A | * | 2/1992 | Bell | 182/5 |
| 5,174,410 | A | * | 12/1992 | Casebolt | 182/3 |
| 5,329,884 | A | * | 7/1994 | Bell | 119/857 |

(Continued)

FOREIGN PATENT DOCUMENTS

| | | | |
|---|---|---|---|
| CH | 595848 | A5 | 2/1978 |
| DE | 2363713 | A1 | 5/1975 |

(Continued)

*Primary Examiner* — Alvin Chin-Shue

(74) *Attorney, Agent, or Firm* — Seed Intellectual Property Law Group PLLC

(57) ABSTRACT

There is provided a full body harness comprising a chest strap, an abdomen strap and a damping unit between the chest strap and the abdomen strap. The damping unit is adapted in the event of a fall to limit the maximum loading acting on the wearer of the harness. The damping unit has a connection for connection to an external runner.

15 Claims, 3 Drawing Sheets

(56) References Cited

U.S. PATENT DOCUMENTS

| | | | | |
|---|---|---|---|---|
| 5,487,444 | A * | 1/1996 | Dennington | 182/6 |
| 5,598,900 | A * | 2/1997 | O'Rourke | 182/3 |
| 5,873,432 | A * | 2/1999 | Cho | 182/72 |
| 5,960,480 | A * | 10/1999 | Neustater et al. | 2/456 |
| 6,032,758 | A * | 3/2000 | May | 182/3 |
| 6,158,548 | A * | 12/2000 | May | 182/3 |
| 6,161,647 | A * | 12/2000 | Braden et al. | 182/8 |
| 6,367,582 | B1 * | 4/2002 | Derby | 182/3 |
| 6,427,252 | B1 * | 8/2002 | Lewis et al. | 2/326 |
| 6,527,082 | B1 * | 3/2003 | Taylor | 182/3 |
| 6,820,721 | B1 * | 11/2004 | Henson | 182/5 |
| 6,851,516 | B2 * | 2/2005 | Petzl et al. | 182/3 |
| 7,392,881 | B1 * | 7/2008 | Choate | 182/4 |
| 8,292,028 | B2 * | 10/2012 | Wise | 182/3 |
| 8,584,799 | B1 * | 11/2013 | Dennington | 182/3 |
| 2005/0230184 | A1 * | 10/2005 | Ansaldo | 182/3 |
| 2007/0272484 | A1 * | 11/2007 | Helms | 182/3 |
| 2008/0230311 | A1 * | 9/2008 | Fusco et al. | 182/37 |
| 2009/0071750 | A1 * | 3/2009 | Simard et al. | 182/5 |
| 2010/0163338 | A1 * | 7/2010 | Wood | 182/6 |

FOREIGN PATENT DOCUMENTS

| | | | |
|---|---|---|---|
| DE | 29919016 | U1 | 12/1999 |
| FR | 2760648 | A1 | 9/1998 |
| FR | 2820641 | A1 | 8/2002 |
| JP | 08-336606 | A | 12/1996 |
| JP | 09-168606 | A | 6/1997 |
| JP | 2004-14140 | A | 5/2004 |
| JP | 2008-148803 | A | 7/2008 |
| JP | 2009066259 | | 4/2009 |
| KR | 1996-0036356 | Y1 | 12/1996 |
| TW | M279355 | | 11/2005 |
| WO | 2007068899 | A1 | 6/2007 |

* cited by examiner

SAFETY HARNESS

BACKGROUND

1. Technical Field

The present invention concerns a full body harness.

2. Description of the Related Art

Full body harnesses for people who are at risk of falling have long been known.

DE 299 19 016 U1 discloses a full body harness with shoulder, chest and leg straps which embrace the body of the user so that he is held fast in all situations. Shoulder, chest/abdomen and leg straps can in part have a high level of flexibility or high elasticity. The full body harness has two shoulder straps, an abdomen strap, a chest strap and two leg straps. In that case the shoulder straps are connected to the chest strap.

As general state of the art attention is directed to DE 23 63 713 B2, FR 2 760 648 A1 and FR 2 820 641 A1.

BRIEF SUMMARY

One or more embodiments of the present invention is to provide a full body harness which reduces the loading on a wearer of the harness in the event of a fall.

In one embodiment there is provided a full body harness comprising a chest strap, an abdomen strap and a damping unit between the chest strap and the abdomen strap. The damping unit is adapted in the event of a fall to limit the maximum loading acting on the wearer of the full body harness. The damping unit has a connection or a fixing unit for connection to an external runner. The damping unit is adapted in the event of a fall to at least partially pull apart in order to at least partially absorb the energy of the fall.

In a further aspect of the invention the damping unit has two layers which are woven together or at least two layers which are sewn together, which pull apart upon a fall.

In a further aspect of the invention the damping unit is sewn in the longitudinal direction and/or in the transverse direction, wherein the seams at least partially tear open in the event of a fall to at least partially absorb the energy of the fall.

In one embodiment, the invention utilizes the idea of providing a full body harness comprising two shoulder straps, an abdomen strap, a chest strap and two leg straps. Provided between the abdomen strap and the chest strap is an energy-absorbing element or a damping element which in the case of a fall can absorb energy or can damp the fall so that the loading on the body of the wearer of the harness is reduced or limited to a maximum amount. Then for example a runner which in turn runs in a rail can be fixed to the energy-absorbing element or the damping unit.

The energy-absorbing unit or the damping unit can represent a tear-apart fall damper, a frictional fall damper, a shock-yard or the like.

With the full body harness according to the invention it is also possible to prevent the wearer of the harness getting into an upper body-back overhang position in the event of a fall.

BRIEF DESCRIPTION OF THE SEVERAL VIEWS OF THE DRAWINGS

Advantages and embodiments by way of example of the invention are described in greater detail hereinafter with reference to the drawing.

DETAILED DESCRIPTION

Figure 1:
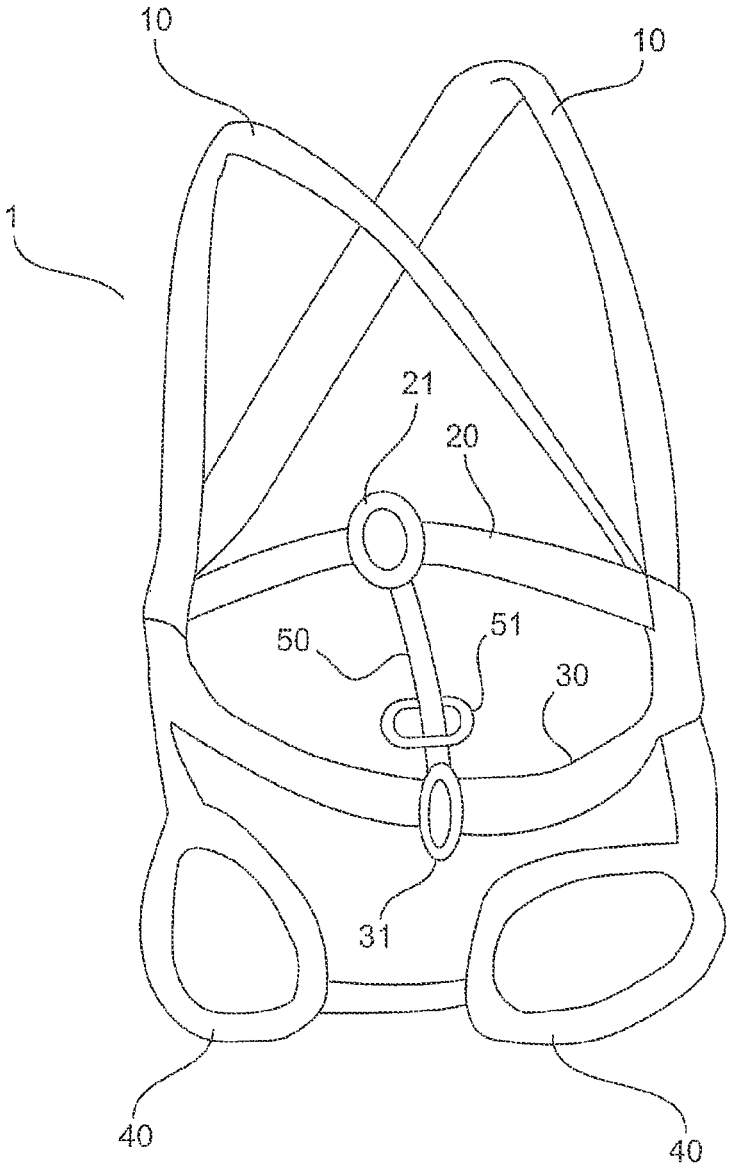
FIG. 1 shows a diagrammatic view of a full body harness according to a first embodiment.

FIG. 1 shows a diagrammatic view of a full body harness according to a first embodiment. The full body harness of the first embodiment has two shoulder straps 10, a chest strap 20, an abdomen strap 30 and two leg straps 40. The shoulder straps 10 are preferably fixed to the chest strap 20 or at least partially fixed thereto. A ring 21 can be provided in the middle of the chest strap 20. A ring 31 can also be provided in the middle of the abdomen strap 30. An energy-absorbing element or a damping unit 50 is provided between the chest strap 20 and the abdomen strap 30. Preferably the damping unit 50 is provided between the ring 21 and the ring 31. The damping unit 50 can have a ring 51 or a fixing unit to which for example a runner can be fixed.

Figure 2:
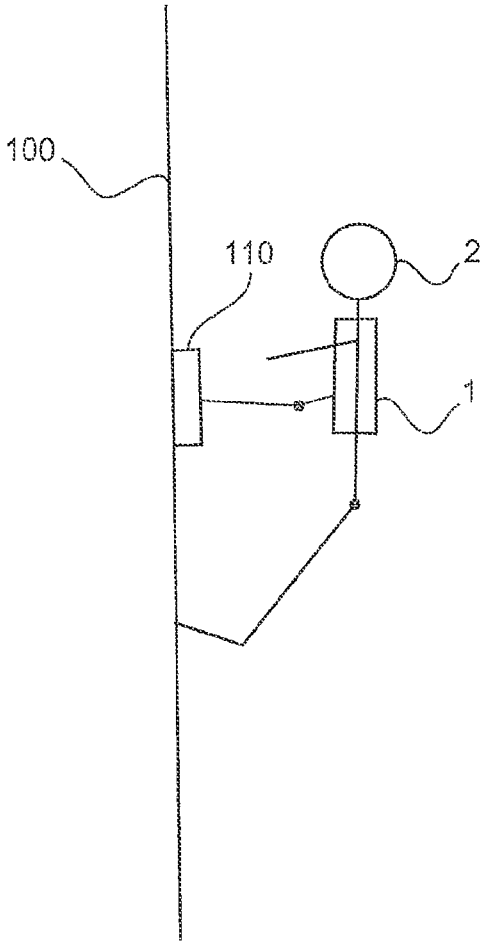
FIG. 2 shows a diagrammatic view of a person with a full body harness according to a second embodiment on a ladder.

FIG. 2 shows a diagrammatic view of a user with the full body harness of FIG. 1. FIG. 2 shows a ladder 100 with a runner 110 and a person 2 with the full body harness 1 of FIG. 1.

The full body harness according to the invention can be used as a rescue harness, climbing harness and so forth.

In one embodiment the full body harness according to the invention is intended to serve to provide a shock absorption capacity of a maximum 6 kN in the transition point between a fall-arresting safety device which moves therewith (runner) and a safety harness arrestor eye of the full body harness. In addition the full body harness according to the invention serves to avoid an upper body-back overhang position which can occur due to an excessively high center of gravity of the body. The full body harness is able to transmit impact force energy in the event of a fall from the runner-arrestor system transition point to the damping unit.

As described above, the full body harness, has a damping unit 50 between the chest strap 20 and the abdomen strap 30. In one embodiment, the damping unit 50 is in the form of a damping element which at least partially tears in the event of a fall. That tearing effect can also be used as a fall indicator so that a full body harness with a damping element 50 which has torn or partially torn away cannot be used again.

Figure 3:
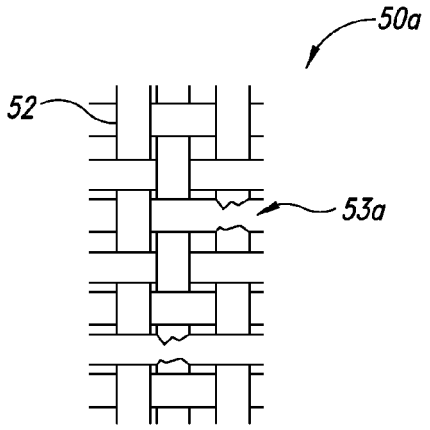
FIG. 3 shows a portion of the damping unit according to one embodiment to illustrate woven layers torn apart.
Figure 4:
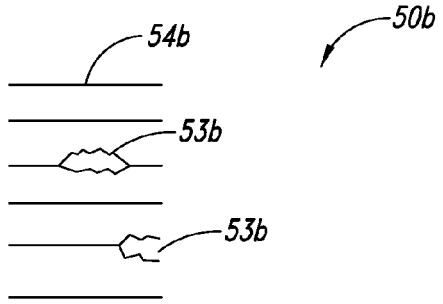
FIG. 4 shows a portion of the damping unit according to one embodiment to illustrate sewn seams torn apart in the longitudinal direction.
Figure 5:
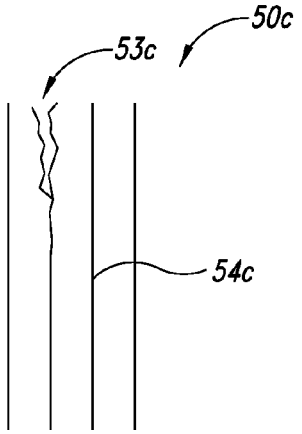
FIG. 5 shows a portion of the damping unit according to one embodiment to illustrate sewn seams torn apart in the transverse direction.

The damping unit or the energy-absorbing unit 50 can have one or more loops 51. It can also comprise a plurality of layers which for example are sewn or glued together and which tear apart in the event of a fall to limit the maximum loading on the wearer of the harness. As an alternative thereto a damping element 50*a* can comprise a plurality of layers 52 which are woven together, in which case the woven layers at least partially tear apart 53*a* in the event of a fall and thus can absorb the energy of the fall, as best shown in FIG. 3. Alternatively or additionally a damping element 50*b* can be woven together by a plurality of perpendicular seams 54*a*, in which case the seams at least partially tear apart 53*b* in the event of a fall and can thus absorb the energy of the fall as best shown in FIG. 4. Alternatively or additionally the seams 54*c* can be provided in the longitudinal direction as best shown in FIG. 5.

The various embodiments described above can be combined to provide further embodiments. All of the U.S. patents, U.S. patent application publications, U.S. patent application, foreign patents, foreign patent application and non-patent publications referred to in this specification and/or listed in the Application Data Sheet are incorporated herein by reference, in their entirety. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A full body harness comprising:

a front chest strap that traverses a user's chest substantially horizontally from a right front side of the user to a left front side of the user when worn by the user;

a front abdomen strap that traverses the user's abdomen below the front chest strap substantially horizontally from a right front side of the user to a left front side of the user when worn by the user;

a runner adapted to run in a rail;

a ring or a fixing unit coupled to the runner; and a damping unit having a first end, a middle portion, and a second end, the middle portion being between the first and second ends, the first end directly coupled to a center portion of the chest strap and the second end directly coupled to a center portion of the abdomen strap, the damping unit having a single longitudinal axis extending vertically between the center portion of the front chest strap and the center portion of the front abdomen strap, the ring or the fixing unit being directly coupled to the damping unit in the middle portion, the damping unit connected to the runner by the ring or the fixing unit, and the damping unit comprising a plurality of first layers that are sewn together and are configured to at least partially tear apart in the event of a fall and reduce a loading transferred to a person wearing the harness.

2. The full body harness according to claim 1 wherein the damping unit comprises a plurality of second layers that are woven together and are configured to tear apart in the event of a fall.

3. The full body harness according to claim 1 wherein the damping unit is sewn at seams in at least one of the longitudinal direction and the transverse direction, the seams being configured to at least partially tear apart in the event of a fall.

4. The full body harness according to claim 1 further comprising:

two leg straps coupled to the abdomen strap, and two shoulder straps coupled to at least one of the front chest strap and the front abdomen strap.

5. The full body harness according to claim 1 wherein the front chest strap has a first ring and the front abdomen strap has a second ring, the damping unit being fixed between the first and second rings.

6. The full body harness according to claim 1 wherein the damping unit extends between the front chest strap and the front abdomen strap such that when worn by a user, the damping unit is located in front of the user's body.

7. The full body harness according to claim 1, further comprising first and second shoulder straps having ends that are fixed directly to the front chest strap.

8. A harness comprising:

a front chest strap traversing a user's chest substantially horizontally from a right front side of the user to a left front side of the user when worn by the user;

a front abdomen strap traversing the user's abdomen substantially horizontally from a right front side of the user to a left front side of the user when worn by the user, wherein the front abdomen strap traverses the user's abdomen below the front chest strap;

a runner adapted to run in a rail;

a fixing unit coupled to the runner; and a damping unit having a first end, a second end, and a middle portion between the first and second ends, the first end of the damping unit directly coupled to a middle portion of the front chest strap and the second end of the damping unit directly coupled to a middle portion of the front abdomen strap, the damping unit having a single longitudinal axis extending vertically from the middle portion of the front chest strap and the middle portion of the front abdomen strap, the fixing unit being directly coupled to the damping unit in the middle portion, the damping unit being coupled to the runner by the fixing unit, the damping unit being configured to tear in response to a threshold load being applied to it.

9. The harness according to claim 8 wherein the threshold load is applied to the damping unit when a person using the harness falls while the fixing unit is coupled to the runner.

10. The harness according to claim 8 wherein the damping unit includes a plurality of layers woven together at seams.

11. The harness according to claim 8 further comprising one or more of seams coupling layers of the damping unit together, wherein the one or more seams at least partially tears apart in response to the threshold load being applied to the damping unit.

12. The harness according to claim 8 wherein the first end of the damping unit is coupled to the front chest strap at a first ring, and the second end of the damping unit is coupled to the front abdomen strap at a second ring.

13. The harness according to claim 8 wherein the fixing unit is in a shape of a ring.

14. The harness according to claim 8 wherein the damping unit extends between the front chest strap and the front abdomen strap such that when worn by a user, the damping unit is located in front of the user's body.

15. The harness according to claim 8, further comprising first and second shoulder straps having ends that are fixed directly to the front chest strap.

* * * * *